United States Patent [19]

Decuq

[11] 4,433,704

[45] Feb. 28, 1984

[54] MECHANICAL CORDING AND HEALD SYSTEM CONTROLLED BY PULLEYS

[75] Inventor: Guy Decuq, Lyons, France

[73] Assignee: Verdol S.A., Caluire, France

[21] Appl. No.: 310,715

[22] Filed: Oct. 13, 1981

[30] Foreign Application Priority Data

Oct. 15, 1980 [FR] France ..... 80 22421

[51] Int. Cl.[3] ..... D03C 1/12

[52] U.S. Cl. ..... 139/66 R; 139/76

[58] Field of Search ..... 139/66 R, 76, 77

[56] References Cited

U.S. PATENT DOCUMENTS 1,759,047 5/1930 Edelstein et al. ..... 139/66 R
3,889,720 6/1975 Porter ..... 139/66 R
4,326,563 4/1982 Brock et al. ..... 139/76

FOREIGN PATENT DOCUMENTS 1305638 3/1961 France .
2398229 2/1979 France .
2457915 12/1980 France .
717174 2/1980 U.S.S.R. ..... 139/76

*Primary Examiner*—Henry Jaudon
*Attorney, Agent, or Firm*—Dowell & Dowell

[57] ABSTRACT

For use on a loom having a pattern selector, a plurality of heddle raising units, each comprising a pulley supported on a shaft and having a funicular cording member wound on the pulley and supporting a heddle, the shaft supporting two annular driving members on which the pulley is journaled, and the unit having means for rotating one annular member in one direction and the other annular member in the opposite direction synchronously with the cycle of the loom, and the pattern selector controlling a device for selectively coupling the pulley to the one of the annular members whose rotation is in the correct direction to wind the funicular member on the pulley to raise the attached heddle.

8 Claims, 31 Drawing Figures

MECHANICAL CORDING AND HEALD SYSTEM CONTROLLED BY PULLEYS

The general term of mechanical cording and heald systems is known to designate the devices which make it possible automatically to control the raising and lowering of the heddles bearing the eyelets through which pass the warp yarns with a view to insertion of the weft in the weaving looms. A distinction is sometimes made between, on the one hand, those systems derived from the one designed by Jacquard and which may ensure the individual control of these heddles by means of hooks, and, on the other hand, the dobbies which act on frames in each of which is mounted a large number of heddles.

Whether it is question of systems with individual hooks or of dobbies with frames, the basic problem resides in the selective lifting or lowering control of individual devices, whether the latter involve a single heddle or a frame containing a plurality of such heddles. To solve this problem, means other than the hooks and the grippers which raise them have been imagined. Systems with electromagnets have thus been set up, acting either directly or rathermore via mechanical relays. It has also been proposed to attach to a pulley the cording or other funicular lifting member corresponding to one or more heddles and to impart, selectively, to this pulley rotations of less than 360° in one direction and in the other from elements moving in alternating motion in synchronism with the functioning of the loom with which the system is associated, so as to lift or lower the cording at the desired instants. However, the means provided for actuating the pulleys of the system in this way are relatively complicated and of high cost price, whilst, further, they require considerable space, which is an important drawback in a cording and heald system.

It is an object of the invention to provide a mechanical system with pulleys for actuating the cordings or heddles in which the means provided for selectively driving the pulleys in rotation in one direction or in the other are particularly simple, inexpensive and of very small dimensions.

According to the present invention, pulleys are also used for controlling the heddles or cordings of the harness, each of which pulleys is mounted on at least one rotating member, but an alternating angular movement of less than 360° amplitude is imparted on said rotating member and connecting means are provided between this member and the corresponding pulley, which are adapted to be selectively actuated, or left unactuated, whilst a device is associated with the pulley in question which allows actuation of the corresponding connecting means during any desired cycle of the system.

In a first embodiment, the rotating member is constituted by a shaft common to at least a certain number of the pulleys of the system, whilst the connecting means associated with each pulley comprise a first depression hollowed in the periphery of the shaft, a second provided in the wall of the bore of the pulley and a rolling element adapted to be housed in retracted position in the depression in this pulley, the elements being arranged such that, in the rest position of the pulley (low position of the heddle), the rolling element remains in the depression of the pulley which is then not driven by the shaft, whilst, when the first and second depression pass opposite one another during the rotation of the shaft in the direction corresponding to the raising of the heddle, an actuating finger passing through a radial perforation in the pulley may push the rolling element in the depression of the shaft, the latter and that of the pulley being shaped in cross section so that wedging occurs and the pulley is driven by the shaft during a cycle of operation of the system at the end of which said element drops in retracted position in the depression of the pulley if the actuating finger is itself retracted.

The actuating finger and the radial perforation in the pulley through which it acts on the rolling element are advantageously profiled so that the latter is pushed against an appropriate spring when the pulley begins to be driven by the shaft.

It is known that a first important improvement which appeared in conventional systems, particularly of the Jacquard type and its derivatives (Vincenzi and especially Verdol), constituted the system called an open shed system, i.e. an assembly of devices maintaining in high position a heddle which must be located in this same position during the following cycle of the system, thus avoiding it having to descend unnecessarily, only to rise again thereafter. The present invention lends itself perfectly well to the execution of such a system. It requires that one provide retaining means adapted to maintain the normal position of the pulley of the heddle in question so as to prevent it from rotating to the rear with the shaft, and to profile the depressions within the pulley so that, at the beginning of the return movement of this shaft, the rolling element is pushed into retracted position in that of the pulley.

In a preferred embodiment, the pulley is provided with an outer hollow disposed so that, in the lifted position of the heddle, it is located opposite the actuating finger, so that, if the heddle must remain in said position, the finger engages the rolling element therein and retains the pulley, the depressions which cooperate with the rolling element being sectioned so that, during the return movement of the shaft, this element is automatically pushed into retracted position in the depression in the pulley. Furthermore, it is advantageous to make the cording in the form of tape which winds on the pulley and to provide the face of this tape which is turned towards the pulley with a point or projection which engages in the radial perforation in the pulley to urge the rolling element in the depression in the shaft, thus ensuring the return stroke when the finger is disengaged from the hollow.

Another important improvement made to cording and heald systems is the double lift system according to which the lowering of the heddles which must pass from the high position to the low position is effected at the same time as the raising of those which, on the contrary, must pass from the low position to the high position. For the same speed of the pieces, for example of the selection members and the hooks in the case of a conventional system, the rate of opening and closure of the shed is doubled, i.e. the speed of weaving. There again, the present invention is adaptable to such a system. Each pulley is in such a case associated no longer with one, but with two coaxial rotating members driven in an alternating angular movement of the same amplitude and same frequency with a phase shift of a half-period connecting means are provided so that they enable the pulley to be connected to that one of these two rotating members which is substantially at the same dead centre as it, i.e. at bottom dead centre if it is question of raising the heddle, or, on the contrary, at top dead centre if it is question of lowering it.

The rotating members may be constituted by two rings mounted on the same shaft. One of these rings may be keyed on the shaft suitably driven in angularly rotating movement, whilst the other, provided to be freely rotatable, is provided with a lateral toothing meshing with a gear oscillating in phase synchronism with the shaft. As a variant, the two rings may both be freely rotatable on the shaft which is fixed and may each comprise a toothing driven by an individual gear. There again, the connecting means advantageously comprise, on the one hand, a depression on the periphery of each ring acting as a rotating member and a corresponding depression in the wall of the bore of the pulley, this pulley depression being sufficiently wide in the axial direction to span one or the other of the first two. On the other hand a ball can be used in cooperation with these depressions, the depression of the pulley opening outwardly through a radial perforation in which may be driven an actuating finger adapted to act on the ball.

Of course, the double lift system can be combined with the open shed system here also made by means of an outer hollow provided in the pulley to receive the actuating finger at the top dead centre position of said pulley. The tape for drawing the heddle is also provided with the projection adapted to be driven in the perforation of the pulley to push the ball. In addition, to facilitate insertion thereof in the depression in one of the rings, which necessarily involves a certain lateral displacement (therefore in the axial direction), each ring is preferably provided with a sort of local lateral bevel provided so as to be located at right angles to the depression of the pulley when the ball is actuated.

The accompanying drawing, given by way of example, will enable the invention to be more readily understood, as well as the characteristics which it presents and the advantages which it may procure:

Figure 1:
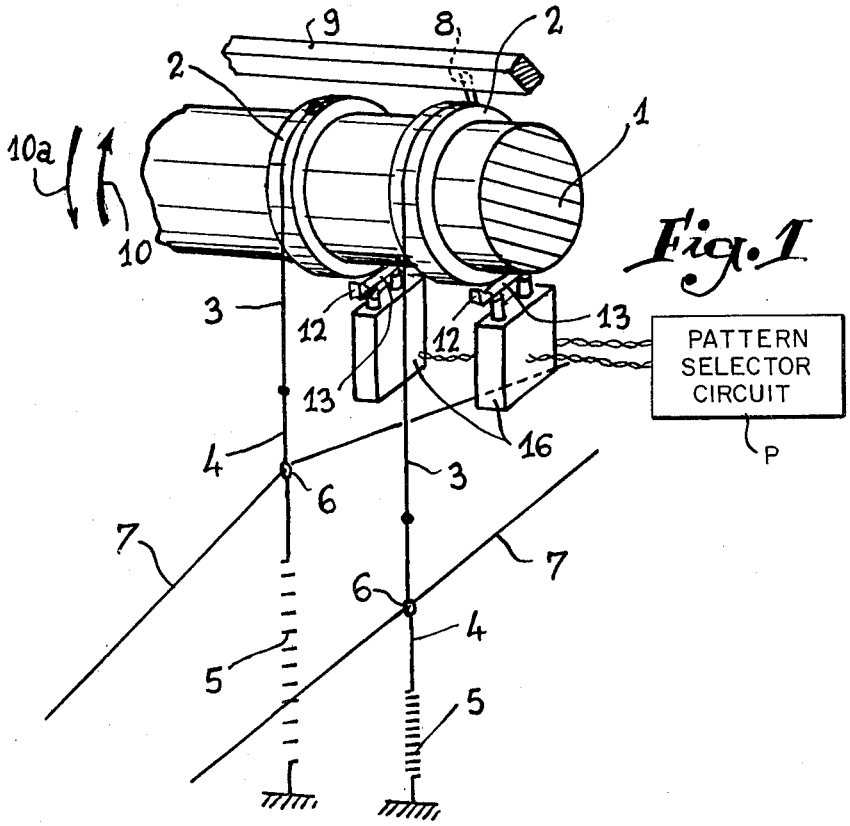
FIG. 1 is a schematic view in perspective of a mechanical system according to a first embodiment of the invention.

In the perspective view shown schematically in FIG. 1, 1 represents a shaft animated by an alternating rotating movement. For the sake of discussion it will be assumed that the amplitude of this movement is 150°, it being understood that this is not compulsory. The means used for driving the shaft 1 in this way have not been shown, but they are easy to imagine. For example, a crank may be fixed thereon to which is coupled a connecting rod articulated on the other hand to a crank pin carried by a shaft driven in continuous rotation, in synchronism with the functioning imposed on the system, i.e. with that of the corresponding weaving loom. On the shaft 1 are idly mounted pulleys 2 on each of which is wound a funicular member 3 constituted, preferably, by a tape (as will be seen hereinafter) to which is attached a heddle 4 of the weaving loom in question, this heddle being urged downwardly by a return spring 5. Each heddle bears a eyelet 6 traversed by a warp yarn 7. Only two pulleys have been shown, but it is obvious that a number of pulleys is provided which is equal to the number of the warp yarns or groups of warp yarns to be controlled, said pulleys further being able to be distributed over a plurality of shafts 1 disposed side by side, if desired.

Each pulley 2 bears a radial lug 8 (cf. FIG. 4 for example) which, when the warp yarn 7 is at the lowered position (right-hand yarn 7 in FIG. 1), abuts against a common crosspiece 9 which extends parallel to the shaft 1 and which limits the contraction of the corresponding return spring 5.

To simplify explanations, the angular lifting stroke achieved by rotation of the shaft 1 is effected in the direction of arrow 10 and by which the pulley 2 in question is driven with the shaft, raising the heddle 4 which is associated therewith. Consequently, for shaft 1, a top dead centre position is defined (at the end of 150° in the direction of arrow 10) and a bottom dead centre position corresponding to the end of heddle-lowering rotation of 150° in the direction of the arrow 10*a*. This same terminology may furthermore be applied to the pulleys, as will be more readily understood hereinafter.

Figure 2:
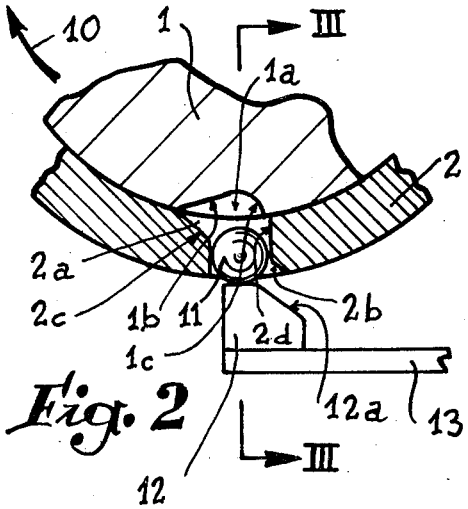
FIG. 2 is a transverse section in detail through the mean plane of a pulley, the pieces being shown at the instant when a depression in the shaft passes opposite the depression in the corresponding pulley, the click ball being in retracted position.
Figure 4:
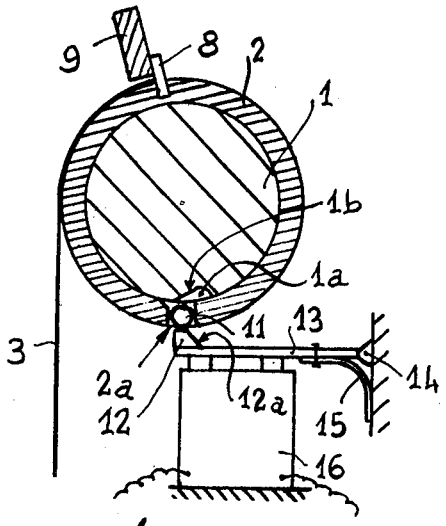
FIG. 4 is a complete transverse section through the mean plane of the pulley, the pieces being shown at the end of the return movement of the rotating shaft which controls the pulleys.

In the periphery of the shaft 1 is provided, at right angles to each pulley 2, a depression 1*a* which, when the shaft is at bottom dead centre, is located in the lower zone thereof, slightly beyond the position shown in FIG. 2 in the return direction (direction opposite that of arrow 10), namely more exactly as indicated in section in FIG. 4. The pulley 2 itself, also supposed to be in the low position of the heddle to which it corresponds (bottom dead centre of this pulley) comprises in its inner bore, by which it is mounted on the shaft 1, a depression 2*a*, but which continues in the direction of the outside by an opening perforation 2*b*. As clearly shown in FIG. 2, the depressions 1*a* and 2*a* are sectioned so as to comprise, upstream with respect to the arrow 10, an inclined plane 1*b*, 2*c* respectively, whilst, downstream, the first 1*a* terminates in a wall 1*c* with quarter-circle section and the second 2*a* in a straight wall 2*d* oriented somewhat radially.

The depressions 1*a* and 2*a* cooperate with a rolling element constituted by a ball 11. The respective dimensions are such that this ball may be housed in retracted position in the depression 2*a* of the pulley, engaging partly in the perforation 2*b* if necessary, but that, on the contrary, the depression 1*a* of the shaft can receive only approximately half of the ball, the other half radially projecting in the depression 2*a*.

Furthermore, an actuating finger 12 is provided below each pulley 2, said finger being adapted to be engaged in the perforation 2*b* to push the ball 11. This finger comprises a bevel 12*a* on its downstream edge with respect to arrow 10. It is carried by an arm 13 articulated at 14 (FIG. 4) on the frame of the system and it is urged in the direction of the pulley 2 by a spring 15. The arm 13 is made of iron or mild steel so as to be able to cooperate with an electromagnet 16 adapted to maintain it in the lowered position against the reaction of the spring 15.

Operation is as follows:

In FIG. 4, the cording or tape 3 is in low position with the heddle which it controls. The lug 8 is in abutment against the common cross piece 9 and the pulley 2 is therefore at its bottom dead centre. The shaft 1 is also at its bottom dead centre, its depression 1*a* having slightly exceeded that 2*a* of the pulley during the preceding return movement (direction opposite arrow 10). The electromagnet 16 is energised and it retains the arm 13 in a position for which the finger 12 is substantially disengaged from the perforation 2*b*. The ball 11 is entirely housed in the depression 2*a* and the perforation 2*b* (retracted position with respect to the shaft 1).

Figure 3:
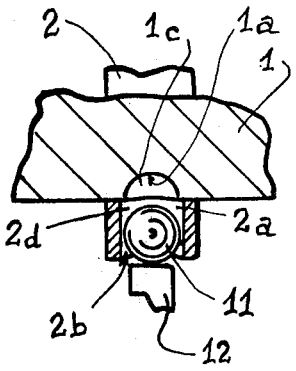
FIG. 3 is a longitudinal section corresponding to line III—III of FIG. 2.
Figure 5:
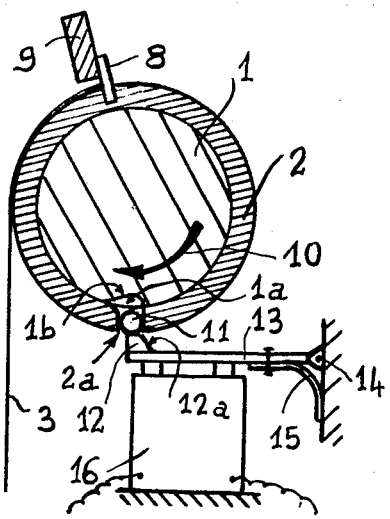
FIGS. 5 to 11 are views similar to that of FIG. 4, but corresponding to other instants of the successive operating cycles.
Figure 6:
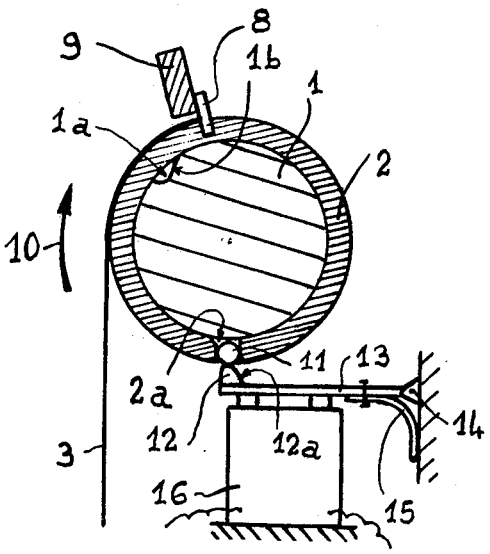

When the shaft begins its advance stroke or lifting stroke, in the direction of arrow 10, its depression 1*a* passes just opposite that 2*a* of the pulley (position of the pieces shown in FIGS. 2, 3 and 5), but as the ball 11 is in retracted position, the pulley is not driven. The shaft makes its advance stroke, arrives at its top dead centre (position of FIG. 6), then returns, all this without driving the pulley. The corresponding heddle therefore remains "low".

Figure 7:
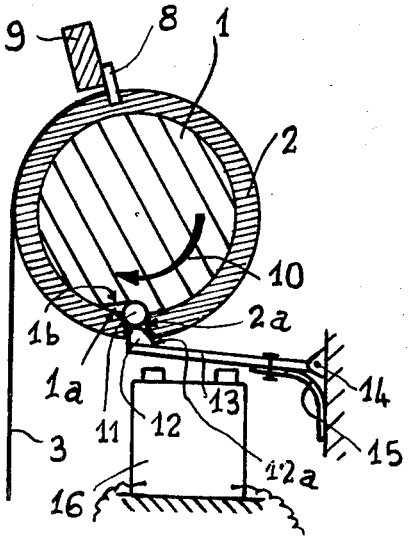

On leaving the position of FIG. 4, if it is assumed, on the contrary, that the electromagnet 16 is not energised, the spring 15 urges the finger 12 upwardly. The ball 11 rises somewhat in the perforation 2*b* and the depression 2*a* of the pulley 2, but it abuts against the periphery of the shaft since the two depressions 1*a* and 2*a* are not opposite each other. As soon as the shaft 1 begins its advance or lifting stroke and its depression 1*a* comes above that 2*a* of the pulley, the ball engages in the first under the effect of the finger 12 raised by the spring 15, this engagement being, moreover, progressive due to the inclined plane 1*b*. One arrives, therefore, in the position of FIG. 7 for which said ball 11 is located half in the depression 1*a* and half in that 2*a*. It is clearly seen that the ball thus disposed forms a sort of catch or pin wedged between the incurved downstream wall 1*b* of the depression 1*a* and the upstream inclined plane 2*c* of the depression 2*a*. The pulley 2 is therefore driven by the shaft 1 in the advance or lifting movement of the latter (arrow 10).

Figure 8:
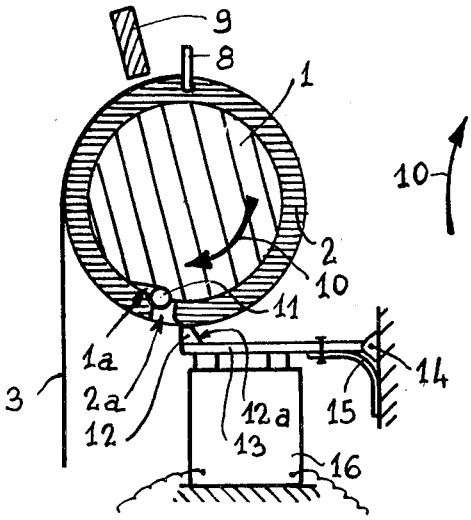
Figure 9:
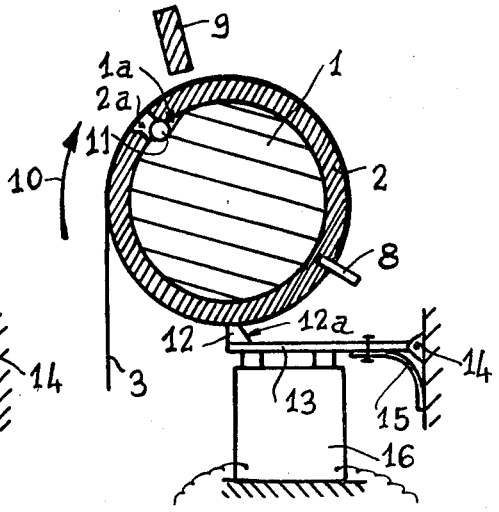

FIG. 8 shows the position of the pieces a little after the ball 11 has thus been wedged. It is seen that, due to its bevelled downstream edge 12*a*, the finger 12 has been pushed downwardly against the reaction of the spring 15 and that it therefore does not hinder the movement. It slides only on the periphery of the pulley. One thus arrives at the top dead centre of the shaft 1 (position of FIG. 9). The pulley 2 is then located in the position for which its heddle is lifted to a maximum (top dead centre of the pulley). Then the shaft 1 makes its return stroke, the ball 11 remaining in wedged position due to the return force exerted by the spring 5 (FIG. 1) associated with the heddle in question. When the radial perforation 2*b* in the pulley 2 returns opposite the finger 12, the lug 8 abuts against the common cross piece 9, stopping the pulley 2 in its bottom dead centre. There may then be two cases:

1. If the electromagnet 16 is energised again, this finger has been lowered, the ball 11 may therefore drop freely in the perforation 2*b* of the pulley to be retracted, its descent being, furthermore, assisted by the inclined plane 1*b* of the depression 1*a* of the shaft 1, which tends to push it downwardly immediately the pulley is stopped. The shaft 1 rotates further by a small angle in the direction opposite arrow 10 to arrive, as well, at its bottom dead centre and one is again in the position of FIG. 4 for a new cycle of the system.

Figure 10:
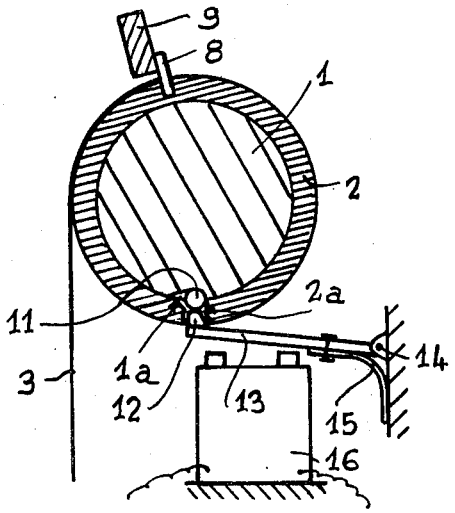

2. If the electromagnet 16 has remained in rest position, the finger 12 engages on passage in the perforation 2*b* (position of FIG. 10), but the pulley 2 being stopped by the lug 8 and the crosspiece 9. The inclined plane 1*b* positively pushes the ball 11 downwardly and the latter lowers in its turn the finger 12 against the reaction of the spring 15. One thus arrives in the bottom dead centre position of the shaft 1 shown in FIG. 11 and which is similar to that of FIG. 4, with the very slight difference that the ball bears against the periphery of the shaft. During the following cycle, if the electromagnet remains de-energized, the ball will rise in the depression 1*a* of the shaft, as explained above, and the pulley 2 will be driven to raise the heddle which is associated therewith. If, on the contrary, the electromagnet 16 is energised, a cycle of non-rotation of the pulley will be occurring again, the heddle remaining in low position.

A single shed system has thus been produced which may control the selective raising and lowering of any number of warp yarns under the effect of the electrical current judiciously sent to the various electromagnets 16 by any suitable pattern selector circuit P, FIG. 1, such circuit comprising mechanical contacts, electronic switches, photoelectric cells, etc.

Figure 11:
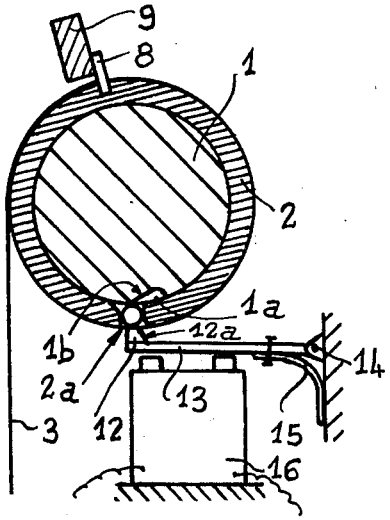

It will further be noted that, for each pulley 2, the electro-magnet 16 does not have to achieve the lowering of the arm 13, since in any case this arm is positively lowered by the effect of the bevel 12*a* at the beginning of rotation of the pulley 2 (position of FIG. 7) and by the ball 11 at the end of cycle, as shown in FIGS. 4 and 11. Therefore, the intensity of the control current may remain relatively weak, which is important for making the mechanical or other switches.

It should be noted that the depression 1*a* of the shaft 1 may be made in the form of a sectioned longitudinal groove, common to all the pulleys 2, this simplifying machining. Furthermore, instead of a ball 11, the use of a roller may just as well be envisaged.

Figure 12:
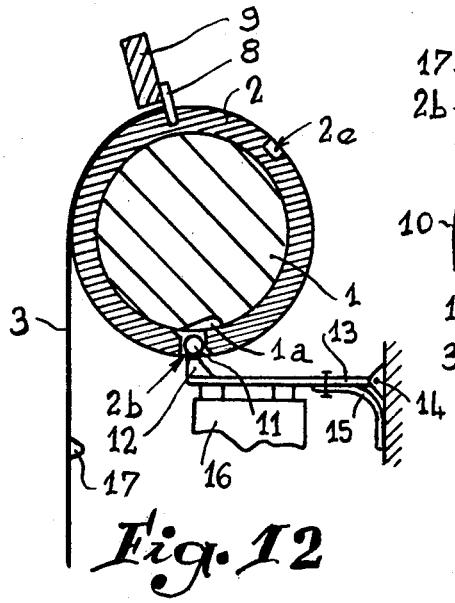
FIG. 12 is a view similar to that of FIG. 4, but corresponding to an embodiment for use with an open shed system.

The open shed embodiment shown in FIG. 12 differs from that of the preceding Figures only in two points:

1. On the periphery of each pulley 2 has been provided an outer hollow 2*e* disposed so that, in the top dead centre position of the pulley (heddle in high position), it is located exactly opposite the finger 12.

2. The cording 3 being made in the form of a flat tape as mentioned hereinabove, a projection 17 has been provided on its face turned towards the pulley 2, said projection disposed and dimensioned so that, in the top dead centre position of the pulley, it engages in the perforation 2*b*.

Figure 13:
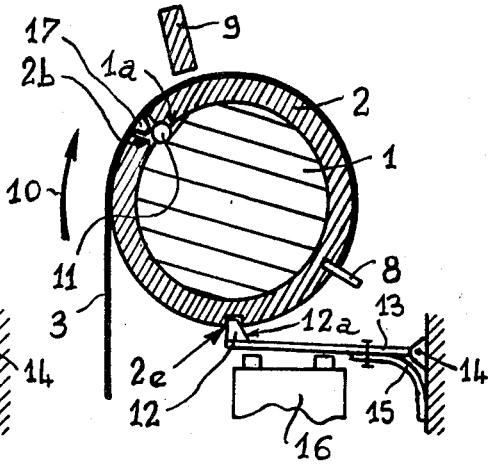
FIGS. 13 to 15 are views similar to that of FIG. 12, but, there again, corresponding to other instants of the operating cycles.

Under these conditions, functioning is as follows: Again leaving the bottom dead centre position of the shaft and of the pulley, which position is that of FIG. 12 (similar to that of FIG. 4), if the heddle corresponding to the pulley in question must rise at the following cycle and then remain raised for one or more cycles, the selector circuits deenergise the electromagnet 16, the arm 13 rises (as indicated in FIG. 11). Upon passage opposite the depressions 1*a* and 2*a*, the ball 11 comes into wedged position (in the manner shown in FIG. 7) and the pulley 2 arrives at its top dead centre. The pieces are then found in the position of FIG. 13. The finger 12 has entered the hollow 2*e* in which it has engaged under the effect of its return spring 15 (FIG. 9)—since the electromagnet 16 is not energised—whilst for its part the projection 17 has driven in the perforation 12*b*, coming into contact with the ball 11, or at least at a short distance therefrom.

Figure 14:
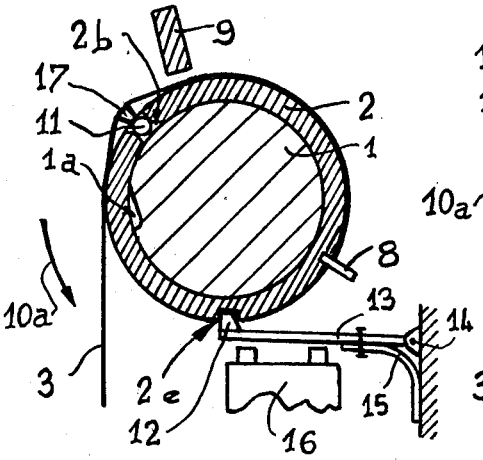

During the return stroke of the shaft 1 (rotation in the direction opposite that of arrow 10), the pulley 2 remains blocked by the finger 12 of which the downstream edge (this term still being used with reference to arrow 10) is oriented substantially radially with respect to the shaft and to the pulley. The inclined plane 1*b* of the depression 1*a* of the shaft therefore pushes the ball 11 which itself pushes the projection 17 to cause it to leave more or less completely the perforation 2*b*, all this being clearly shown in FIG. 14. It will be noted that this displacement of the projection 17 causes a slight excess tension of the tape 3, but this is extremely slight and remains negligible in practice. Finally, the result is that the shaft 1 may return to its top dead centre position, which carries out the open shed system.

Figure 15:
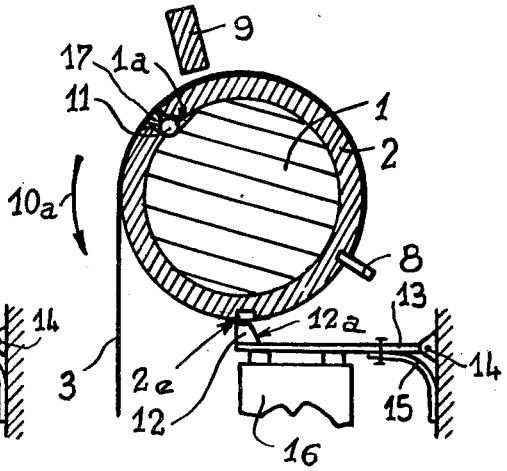

It will be noted that, when, at the following cycle of the system, the shaft 1 returns to its top dead centre position, the projection 17 positively pushes the ball 11 in the depression 1*a*. Two cases are then to be envisaged:

1. The heddle associated with the pulley 2 in question, must return to the low position. In this case, the electro-magnet 16 is energised by the selector circuits and the finger 12 is lowered (as shown in FIG. 15). In the return movement of the shaft 1 and the pulley 2 in the direction opposite that of arrow 10 may be effected as if the hollow 2*e* did not exist. Neither is it hindered by the projection 17 which automatically disengages from the perforation 2*b* during unwinding of the tape 3.

2. The heddle associated with the pulley 2 must on the contrary remain in high position. The electromagnet 16 remains de-energized, the finger 12 remains in the hollow 2*e* and the pulley 2 remains blocked at top dead centre. Therefore, during the beginning of the return movement of the shaft 1 in the direction opposite that of arrow 10, the ball 11 is, there again, driven by the inclined plane 1*b* and operation is again with open shed.

Here, top, the depression 1*a* of the shaft may be made in the form of a sectioned longitudinal groove and the ball 11 may be replaced by a roller. On the contrary, the presence of the projection 17 which must remain oriented towards the pulley imposes that the funicular member 3 be made in the form of a tape or equivalent.

There again, the electromagnet 16 does not have to achieve the lowering of the arm 13 except at the instant of initial selection.

Figure 16:
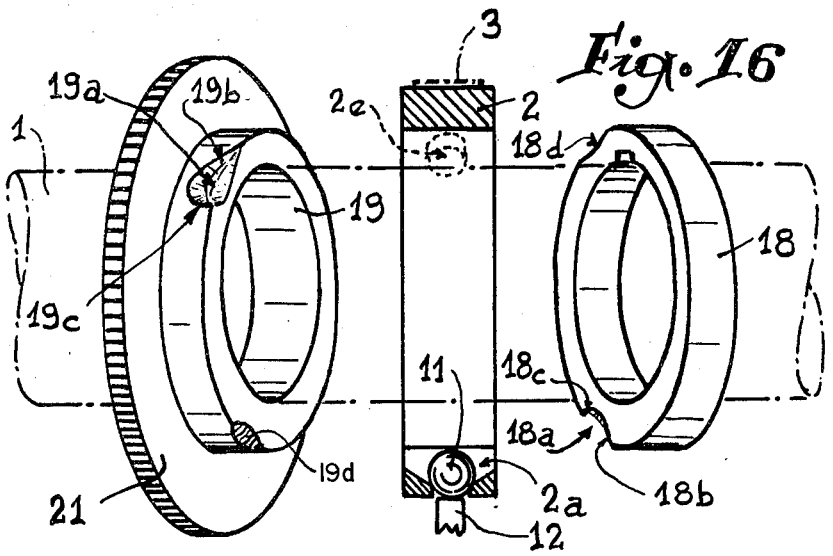
FIG. 16 is a perspective exploded view of an embodiment for a double lift and open shed system.
Figure 18:
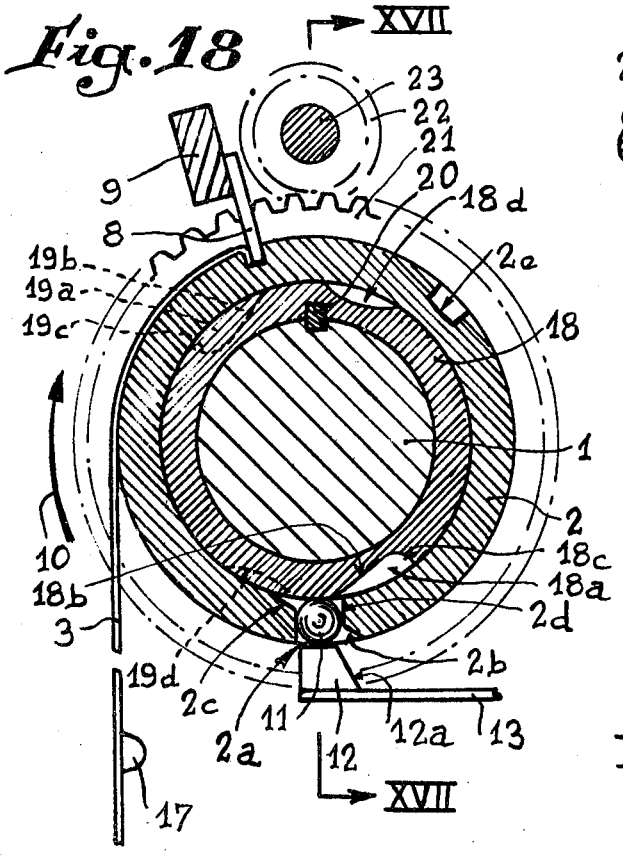
FIG. 18 is a section along XVIII—XVIII (FIG. 17), this view indicating at XVII—XVII the plane corresponding to the section of FIG. 17.
Figure 17:
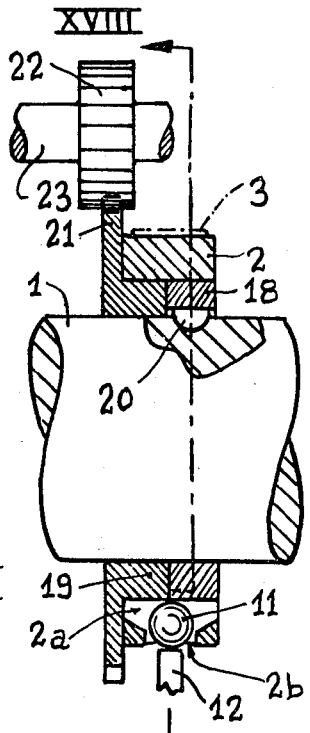
FIG. 17 is an axial section through all the pulley and its drive rings according to FIG. 16.
Figure 19:
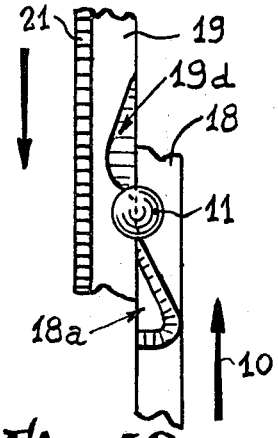
FIG. 19 is a partial view in plan from underneath of the assembly of the two drive rings of the pulley, the latter being assumed to be removed and the pieces located in the position of FIGS. 17 and 18.

The exploded view of FIG. 16 and the sections of FIGS. 17 and 18 show an embodiment of the invention adapted to carry out the double lift system. Here, the pulley 2 no longer rests on a single rotating member (which in the two preceding embodiments was constituted by the shaft 1), but on two members made in the form of rings 18 and 19 juxtaposed on the shaft 1 as indicated in dashed and dotted lines in FIG. 16 for clarity of the drawing), which is, there again, animated by an alternating angular movement. The ring 18 is keyed on this shaft, as indicated by the key 20 in FIGS. 17 and 18, whilst the ring 19 is free to rotate thereon, but is fixed to a toothed wheel 21, of small thickness, which meshes with a gear 22 carried by a secondary shaft 23 parallel to the shaft 1 and driven in synchronism therewith at an amplitude such that said ring 19 oscillates exactly like the ring 18, but with a phase shift of a half-period.

The two rings 18 and 19 are otherwise identical as far as details thereof are concerned, but they are turned to face each other. In other words, it may be considered that, if the keyway of the ring 18 and the wheel 21 associated with the ring 19 were removed, each of them represents the mirror image of the other.

As in the preceding embodiments, the pulley 2 comprises an inner depression 2*a*, but provided to be sufficiently wide to extend over the two rings 18 and 19, as clearly shown in FIG. 17. This depression opens, there again, to the outside via the perforation 2*b*. Each ring comprises, like shaft 1 in FIG. 2 for example, a depression 18*a*, 19*a* suitably sectioned to receive about half of the ball 11 (inclined plane 18*b*, incurved wall 18*c*). However, these depressions open into that one of the lateral faces of each ring which is turned towards the other. In addition, each ring is hollowed on its periphery by a local bevel 18*d*, 19*d* inclined transversely towards the other ring, respectively 19,18, this bevel being disposed at such a point that it comes opposite the depression of this other ring when said depression is opposite the depression 2*a* of the pulley 2 assumed to be at top dead centre or at bottom dead centre. In FIG. 18, one depression is at bottom dead centre, the depression 18*a* of the ring 18 has slightly exceeded the depression 2*a* of the pulley 2 in the direction of the return movement (therefore direction opposite that indicated by arrow 10). Moreover the bevel 19*d* of the ring 19 is substantially at the same angular distance from the depression 2*a* as the depression 18*a*, but on the other side of this depression 2*a*. As a result, when the two rings move in opposite direction, the ring 18 then rotating in the direction of arrow 10 (lifting stroke), the bevel 19*d* and the depression 18*a* will come at the same time opposite the depression 2*a* of the pulley 2.

The embodiment of FIGS. 16 to 28 comprises the actuating finger 12, as well as the open shed hollow 2*e* and the projection 17 (as in FIG. 12).

Operation is as follows:

One will start from the position of FIG. 18 for which the pulley 2 is at its bottom dead centre (lug 8 abutting against the cross piece 9, depression 2*a* and perforation 2*b* at the bottom, ball 11 resting on the finger 12). As indicated above, the ring 18 is itself at its bottom dead centre, its depression 18*a* being slightly to the rear of that 2*a* of the pulley with respect to the arrow 10. On the contrary, the ring 19 is at its top dead centre.

The ring 18 will now make its forward or lifting stroke in the direction of arrow 10, the ring 19 rotating in opposite direction. If the finger 12 is lowered, nothing happens, the tape 3 remains "low". If, on the contrary, this finger is raised by the corresponding spring (spring 15 in FIG. 4), the ball is applied against the two rings, as clearly shown in FIGS. 10 and 20, FIG. 10 being a partial plan view from underneath, the pulley being assumed to be removed to show the rings, and FIG. 20 being a section in detail through an axial plane passing through the centre of the ball 11.

Figure 21:
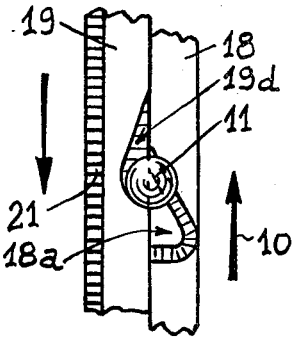
FIGS. 21-22, 23-24, 25-26 and 27-28 are views respectively similar to those of FIGS. 19 and 20, but for other positions of the pieces in the course of an operating cycle.
Figure 23:
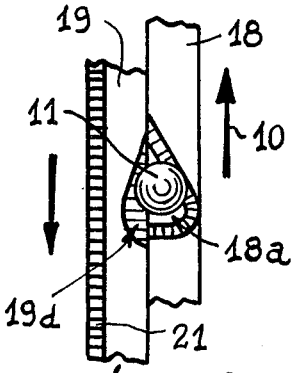
Figure 20:
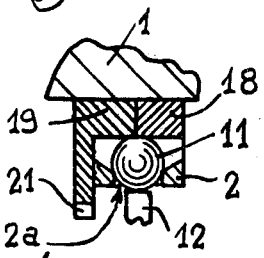
FIG. 20 is a partial axial section through the plane passing through the centre of the ball in FIG. 19.
Figure 22:
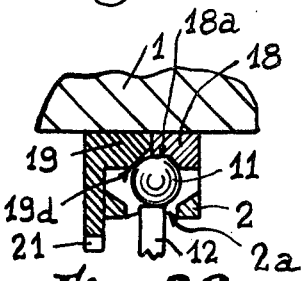
Figure 24:
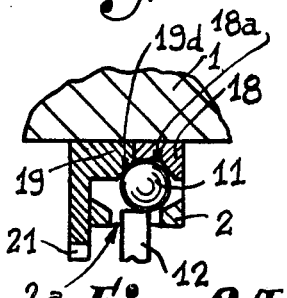
Figure 25:
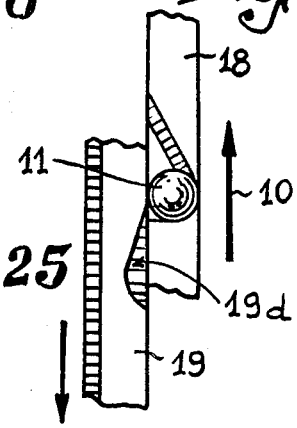

Shortly after the beginning of the movement, the depression 18*a* of the ring 18 as well as the bevel 19*d* of the ring 19 present themselves progressively above the ball 11 (position of FIGS. 21 and 22). Under the effect of the finger 12, the ball engages therein, but the bevel tends to push it laterally towards the ring 18 so that it penetrates more and more in the depression 18*a*, as clearly shown in FIGS. 23 and 24. Towards the end of the crossing of the bevel 19*d* and the said depression 18*a*, the ball 11 is entirely housed in this latter. (FIGS. 25 and 26), thus constituting a pin between the ring 18 and the pulley 2, which is driven in lifting stroke.

If it is assumed that, at top dead centre of the pulley 2 and of the corresponding tape 3, the open shed system does not function (finger 12 lowered), the pulley 2 will return to the rear (return stroke) and so on. If, on the contrary, the finger 12 remains urged by its spring, it engages in the open shed hollow 2*e* of the pulley and maintains it in the raised position of the corresponding heddle (or, if preferred, of the tape 3 to which this heddle is attached).

The two rings 18 and 19 being symmetrical with respect to their plane of contact, functioning, would remain the same even if, when the pulley 2 was passing from its low position to its high position, it was the ring 19 which was located in low position, the ring 18 being, on the contrary, in high position.

Figure 27:
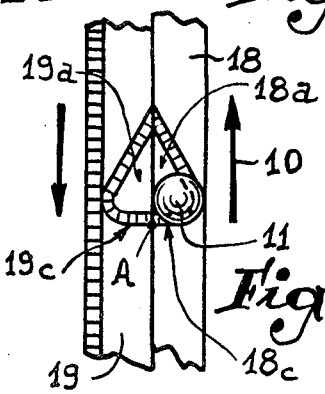
Figure 26:
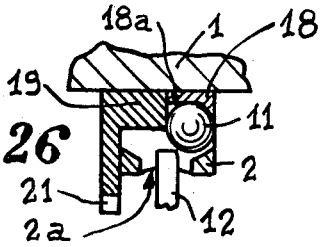
Figure 28:
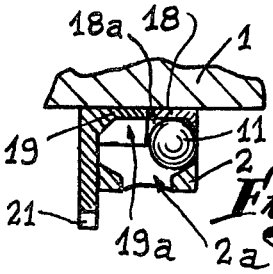

It will be noted that, at half-stroke of the lifting movement, the depressions 18*a* and 19*a* of the two rings 18 and 19 align and pass opposite (position of FIGS. 27 and 28). It would appear that, at that instant, the ball 11 risks passing from one depression into the other, which would bring about an operational fault. However, it should be noted that said ball is then in wedged position and can therefore not move laterally. As a safety measure, the rear wall 18*c*, 19*c* may be further provided with a slight re-entrant part at its junction with the plane of contact of the two rings (point A of FIG. 27), or a very slight flange along the lateral face of each ring turned towards the other.

When the pulley 2 is retained at top dead centre by the finger 12 and the hollow 2*e*, everything occurs as described hereinabove with reference to FIGS. 12 to 15, the ball 11 remaining in the depression 2*a* of the pulley. As soon as the finger 12 is disengaged at top dead centre of one of the rings 18 and 19, the ball 11 engages in the depression 18*a* or 19*a* of this ring to begin the stroke lowering the pulley 2 and the heddle, the bevel of the other ring 19 or 18 intervening, there again, to ensure the correct engagement of this ball under the effect of the pressure exerted by the projection 17.

In FIG. 17, it has been assumed that the secondary shaft 23 carried an individual gear for each wheel 21, but it will be imagined that one single gear 24 (FIG. 29) may be used for driving all the wheels 21 corresponding to a series of successive pulleys 2.

Figure 29:
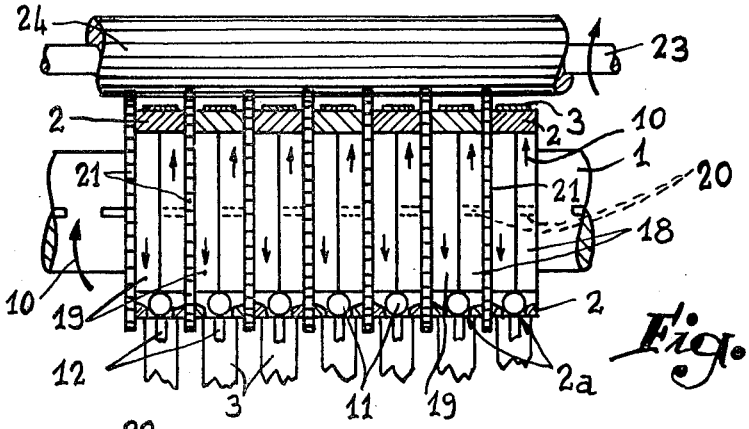
FIGS. 29 to 31 are side views partially in cross section showing various modes of disposition of the rings and various modes of driving same.

In FIG. 29, one wheel 21 is provided for each ring 19, or, if preferred, for each pulley 2. The rings follow each other on the shaft 1 in the simple alternating order 19,18,19,18, etc. but as a variant it is possible to adopt a double alternating series 19, 19,18,18,19,19, etc. as clearly shown in FIG. 30, which comprises two advantages:

1. It is possible to provide a single wheel 21 for two adjacent rings 19.

2. Each pair of rings 19—19, then 18—18 may be made in one piece if desired, which has been indicated in FIG. 30 denoting such a double ring by 18—18.

Figure 30:
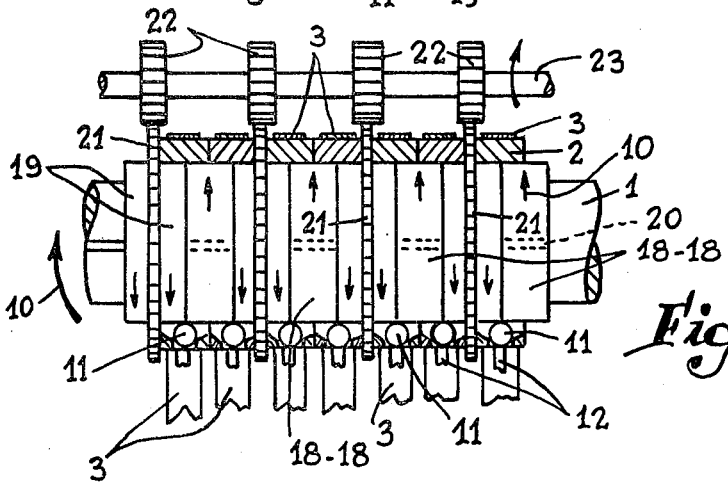

FIG. 30 shows an individual gear 22 for each wheel 21, but nothing would prevent a single gear from being used for all the wheels, as in FIG. 29.

Figure 31:
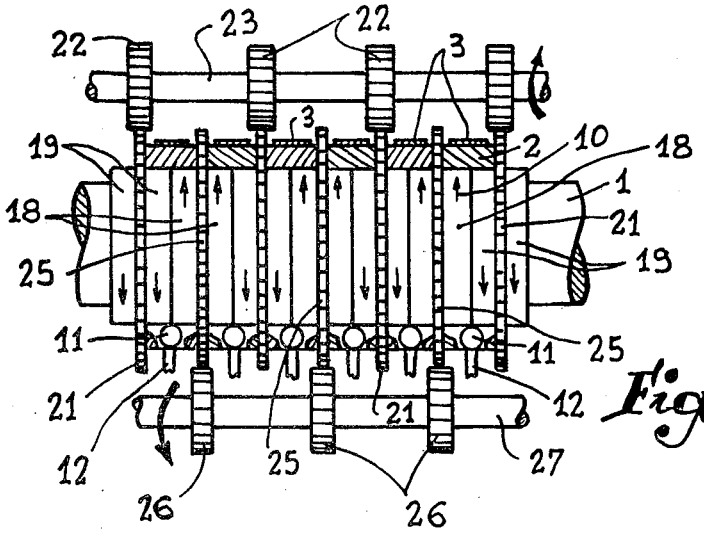

FIG. 31 shows another variant in which the rings 18 are no longer keyed on the shaft 1, which may be fixed, but comprise toothed wheels 25 meshed with gears 26 keyed on another secondary shaft 27. It is understood that the functioning is not changed thereby. In this Figure, it has been assumed that the double alternation 19,19,18,18, etc., had been adopted, the two adjacent rings 19 or 18 being able to be made in one piece, but this is obviously not compulsory.

According to another variant (not shown), any secondary shaft is dispensed with by providing the mechanical system with at least two ring-bearing shafts such as 1 disposed side by side, parallel to each other. A toothed wheel such as 21 is associated with all the rings 18 and 19 of the two shafts and the one of a ring 18 of one shaft is arranged to mesh with that of a ring 19 of the other. It is easy to see that, if the two shafts are driven in rotational movement in synchronous manner, on each of them the idle rings 19 oscillate in direction opposite the keyed rings 18. It is thus possible to set up a mechanical system with multiple ring-bearing shafts, of simplified construction.

The systems are sometimes required to ensure not only the lifting of certain of the warp yarns, but also the lowering of others (so-called lifting and lowering systems). Identical functioning may be obtained easily within the scope of the present invention, simply by oscillating the stop 9. If the case is considered of a pulley 2 which is not to be driven by the shaft 1 and for which the corresponding electromagnet 16 is consequently energised (with reference for example to FIG. 4), it will be understood that if, in the course of the new cycle, the stop 9 turns around the axis of the shaft 1 in anticlockwise direction the heddle attached to the tape 3 will descend whilst those associated with the pulleys selected for lifting will rise. The angle of rotation of the pulleys for lifting must of course be selected so as to allow a sufficient angular extent for the upper end of the tape 3 to remain at least tangential to the pulley 2, for lowering.

Furthermore, it must be understood that the preceding description has been given only by way of example and that it in no way limits the scope of the invention, the replacement of the details of execution by any other equivalents not departing therefrom. Thus, for example, the pulleys and the shaft may be of any diameter. An infinite diameter may even be envisaged, the shaft and the pulleys becoming linear members. Furthermore, although it has been assumed that the connecting member was constituted by a ball, roller or the like, it may also be made in another form, particularly in the form of a loop made at the end of an elastic blade fixed in a shallow hollow made on the periphery of the shaft 1, this loop being urged by the blade in centrifugal direction.

I claim:

1. In a mechanical cording and heald system for looms of the type having a plurality of heddle-raising units controlled by pattern selector means and supported by a common shaft, each unit including a pulley on the outer periphery of which is wound at least one funicular member having an end attached to said pulley and adapted to raise at least one heddle against suitable return means, each funicular member having a low and a high position, stop means to limit the rotation of said pulley under the action of said return means when said funicular member has reached its low position, and means to selectively connect said pulley with driving means rotating alternately in one or the other direction in synchronism with the operative cycle of the loom through an angle of less than 360° to cause said funicular member to move between its low and high positions, each unit comprising:

(a) in said driving means first and second axially juxtaposed annular driving members mounted on the shaft;

(b) means to impart to said driving members oppositely directed angular movements of the same amplitude in synchronism with said loom cycle, whereby at the end of each operative cycle of said loom each of said driving members has completed its rotation, one member being in a first position in which a pulley coupled thereto will reach the end of its stroke by winding the funicular member thereon, and the other member being in a second position in which a pulley coupled thereto will reach the end of its stroke by unwinding the funicular member therefrom; and (c) coupling means under the control of said pattern selector means and operative at the beginning of a loom cycle to selectively connect said pulley with the one of said driving means which is at said second position.

2. In a unit as claimed in claim 1:

(a) said annular driving members having substantially cylindrical outer peripheries of the same diameter and each including a radial face disposed toward the radial face of the other member;

(b) said pulley having an outer periphery and having an inner periphery which is rotatably mounted on both said juxtaposed driving members, said inner periphery being formed with an inner depression having in cross section a first edge substantially perpendicular to said inner periphery and a second edge which is at an acute angle thereto, said second edge leading said first edge when said pulley rotates in a direction corresponding to the winding of said funicular member on the outer periphery, and the pulley having a perforation extending through the outer periphery of the pulley into said depression adjacent said first edge thereof;

(c) each of said driving members having on its outer periphery a recessed depression which opens into its radial face toward the other driving member, said recessed depressions having in cross section a first edge terminating substantially perpendicular to the adjacent outer periphery and having a second edge terminating at an acute angle thereto, and said second edge of said recessed depression leading said first edge thereof when the corresponding driving member rotates in the direction which corresponds to the unwinding of said funicular member from said pulley;

(d) the inner depression of said pulley being of sufficient width to span the recessed depressions of both said driving members when they are aligned;

(e) the coupling means including an actuating finger facing toward the outer periphery of said pulley and moveable radially with respect to thereto, said finger being disposed opposite the perforation of said pulley when said funicular member is at its low position;

(f) a ball disposed in said perforation when said funicular member is at its low position, said ball having a diameter no greater than the width of the recessed depression of either of said driving members but greater than the radial depths thereof; and (g) said recessed depressions being so located on said outer peripheries of said driving members that when one of said driving members is at its second position with its funicular member being in its low position, said inner depression of said pulley will lie below it with the ball contained in the perforation and with said recessed depression of said one driving member passed beyond said perforation, whereby when said one driving member begins its next angular rotation, if said finger is pushed upwardly, said ball will become wedged between the inner periphery of said pulley and the recessed depression of said one driving member to cause said pulley to rotate in a direction corresponding to the raising of said funicular member.

3. In a unit as claimed in claim 2, spring means urging said actuating finger into said perforation in the pulley, and said coupling means comprising an electromagnet operative to selectively retract said finger away from said pulley.

4. In a unit as claimed in claim 3, said actuating finger having a bevel on its edge which is located away from the direction of rotation of said pulley corresponding to winding of said funicular member thereon, whereby the finger is positively pushed outwardly of the perforation at the beginning of rotation of said pulley.

5. In a unit as claimed in claim 1, said shaft being reciprocated through less than 360° in synchronism with the loom cycle, one of said driving members being keyed thereon and the other member being journaled thereon; a secondary shaft rotating oppositely to said shaft; and means connecting the secondary shaft to rotate said other member therewith.

6. In a unit as claimed in claim 1, both said driving members being freely journaled on said shaft; a first and a second secondary shaft driven in opposite rotation synchronously with the loom cycle; and separate means connecting the first secondary shaft to drive one member and the second secondary shaft to drive the other member.

7. A system comprising a plurality of units as claimed in claim 1, including multiple units respectively mounted on common shafts, and mutually adjacent units on a shaft having their driving members located adjacent to each other, each unit sharing its driving members with its adjacent units, and the shared adjacent first and second members being respectively rotated in unison.

8. A unit as claimed in claim 1, wherein said unit includes stop means which is moveable angularly during the operative cycle of the loom to achieve unwinding of said funicular member from said pulley when it is not being driven by one of said driving members.

* * * * *